US005520293A

United States Patent [19]

Hartley

[11] Patent Number: 5,520,293

[45] Date of Patent: May 28, 1996

[54] DOUBLE VIDEO GAME RACK AND CONTROL DECK

[76] Inventor: Brenda G. Hartley, 4716 Sussex Ave., Jacksonville, Fla. 32210

[21] Appl. No.: 350,813

[22] Filed: Dec. 7, 1994

[51] Int. Cl.[6] ..... A47F 5/00

[52] U.S. Cl. ..... 211/182; 211/13; 248/127

[58] Field of Search ..... 211/182, 189, 211/13, 194, 40, 37; 248/165, 176.1, 346.01, 127; 108/180

[56] References Cited

U.S. PATENT DOCUMENTS

| | | | |
|---|---|---|---|
| D. 260,341 | 8/1981 | Harrison | D6/487 X |
| D. 276,010 | 10/1984 | Saltzman | D6/487 |
| 2,923,542 | 2/1960 | Clark et al. | 248/127 X |
| 3,229,790 | 1/1966 | Shayne | 211/182 X |
| 4,681,378 | 7/1987 | Hellman | 211/194 X |
| 5,035,332 | 7/1991 | Stravitz | 211/40 |
| 5,172,816 | 12/1992 | Kline et al. | 211/194 X |
| 5,377,849 | 1/1995 | Martin | 211/13 |
| 5,415,297 | 5/1995 | Klein et al. | 211/194 X |

FOREIGN PATENT DOCUMENTS

| | | | |
|---|---|---|---|
| 586412 | 3/1947 | United Kingdom | 211/182 |

*Primary Examiner*—Robert W. Gibson, Jr.

[57] ABSTRACT

A new and improved video game rack and control deck for holding video games and video game cartridges making them more convenient to store and play comprised of a plurality PVC extensions, T-shaped hollow projections, and elbow joints. The aforementioned elements are capable of being constructed to form a variety of shapes and sizes capable of storing and displaying a variety of video games and video game cartridges.

1 Claim, 4 Drawing Sheets

DOUBLE VIDEO GAME RACK AND CONTROL DECK

BACKGROUND OF THE INVENTION

1. Field of the Invention

The present invention relates to a double video game rack and control deck and more particularly pertains to holding two video games simultaneously making them more convenient to store and play with a double video game rack and control deck.

2. Description of the Prior Art

The use of bookcases is known in the prior art. More specifically, bookcases heretofore devised and utilized for the purpose of holding a variety of objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,209,492 to Hamilton discloses a shooting target stand.

U.S. Pat. No. 5,095,563 to Miller discloses a hammock like portable infant suspender and support assembly.

U.S. Pat. No. Des. 316,195 to Mark discloses the ornamental design for a double helix bookcase.

U.S. Pat. No. Des. 314,877 to Bush et al. discloses the ornamental design for a bookcase.

U.S. Pat. No. 4,102,275 to Spound et al. discloses an adjustable modular bookcase.

While these devices fulfill their respective, particular objective and requirements, the aforementioned patents do not describe a double video game rack and control deck for holding two video games simultaneously making them more convenient to store and play.

In this respect, the double video game rack and control deck according to the present invention substantially departs from the conventional concepts and designs of the prior art, and in doing so provides an apparatus primarily developed for the purpose of holding two video games simultaneously making them more convenient to store and play.

Therefore, it can be appreciated that there exists a continuing need for new and improved double video game rack and control deck which can be used for holding two video games simultaneously making them more convenient to store and play. In this regard, the present invention substantially fulfills this need.

SUMMARY OF THE INVENTION

In the view of the foregoing disadvantages inherent in the known types of bookcases now present in the prior art, the present invention provides an improved double video game rack and control deck. As such, the general purpose of the present invention, which will be described subsequently in greater detail, is to provide a new and improved double video game rack and control deck and method which has all the advantages of the prior art and none of the disadvantages.

To attain this, the present invention essentially comprises a hollow rectangular base having a front piece, a back piece, two side pieces, and an opening therebetween. The front piece and the back piece couple with the two side pieces by elbow joints. The front piece has an inwardly positioned projection that is coupled with a middle portion thereof. The back piece has an inwardly positioned projection that is coupled with a middle portion thereof. Each of the two side pieces has two upwardly extending projections therefrom. Each of the two side pieces has an inwardly positioned projection disposed between the two upwardly extending projections thereof. The device contains a four way projecting piece that is positioned in the opening of the hollow rectangular base. The four way projecting piece has a first extension that couples with the inwardly positioned projection of the front piece. A second extension couples with the inwardly positioned projection of the back piece. A third and fourth extension couple with the inwardly positioned projection of the two side pieces. The four way projecting piece with the attached extensions serves to form a bottom shelf. The device contains a U-shaped upper shelf having a back piece and two side pieces. The back piece couples with the two side pieces by elbow joints. Each of the two side pieces has two downwardly extending projections therefrom. Each of the two downwardly extending projections has a support bar extending therefrom. Each support bar couples with the upwardly extending projections of the two side pieces of the hollow rectangular base. Each of the two side pieces has an inwardly extending projection that is disposed between the two downwardly extending projections thereof. An extension having end portions is coupled with the inwardly extending projections of the two side portions to form an upper shelf.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved double video game rack and control deck which has all the advantages of the prior art bookcases and none of the disadvantages.

It is another object of the present invention to provide a new and improved double video game rack and control deck which may be easily and efficiently manufactured and marketed.

It is a further object of the present invention to provide a new and improved double video game rack and control deck which is of durable and reliable construction.

An even further object of the present invention is to provide a new and improved double video game rack and control deck which is susceptible of a low cost of manufacture with regard to both materials and labor, and which accordingly is then susceptible of low prices of sale to the consuming public, thereby making such a double video game rack and control deck economically available to the buying public.

Still yet another object of the present invention is to provide a new and improved double video game rack and control deck which provides in the apparatuses and methods of the prior art some of the advantages thereof, while simultaneously overcoming some of the disadvantages normally associated therewith.

Even still another object of the present invention is to provide a new and improved double video game rack and control deck for holding two video games simultaneously making them more convenient to store and play.

Lastly, it is an object of the present invention to provide a new and improved video game rack and control deck for holding video games and video game cartridges making them more convenient to store and play comprised of a plurality PVC extensions, T-shaped hollow projections, and elbow joints. The aforementioned elements are capable of being constructed to form a variety of shapes and sizes capable of storing and displaying a variety of video games and video game cartridges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
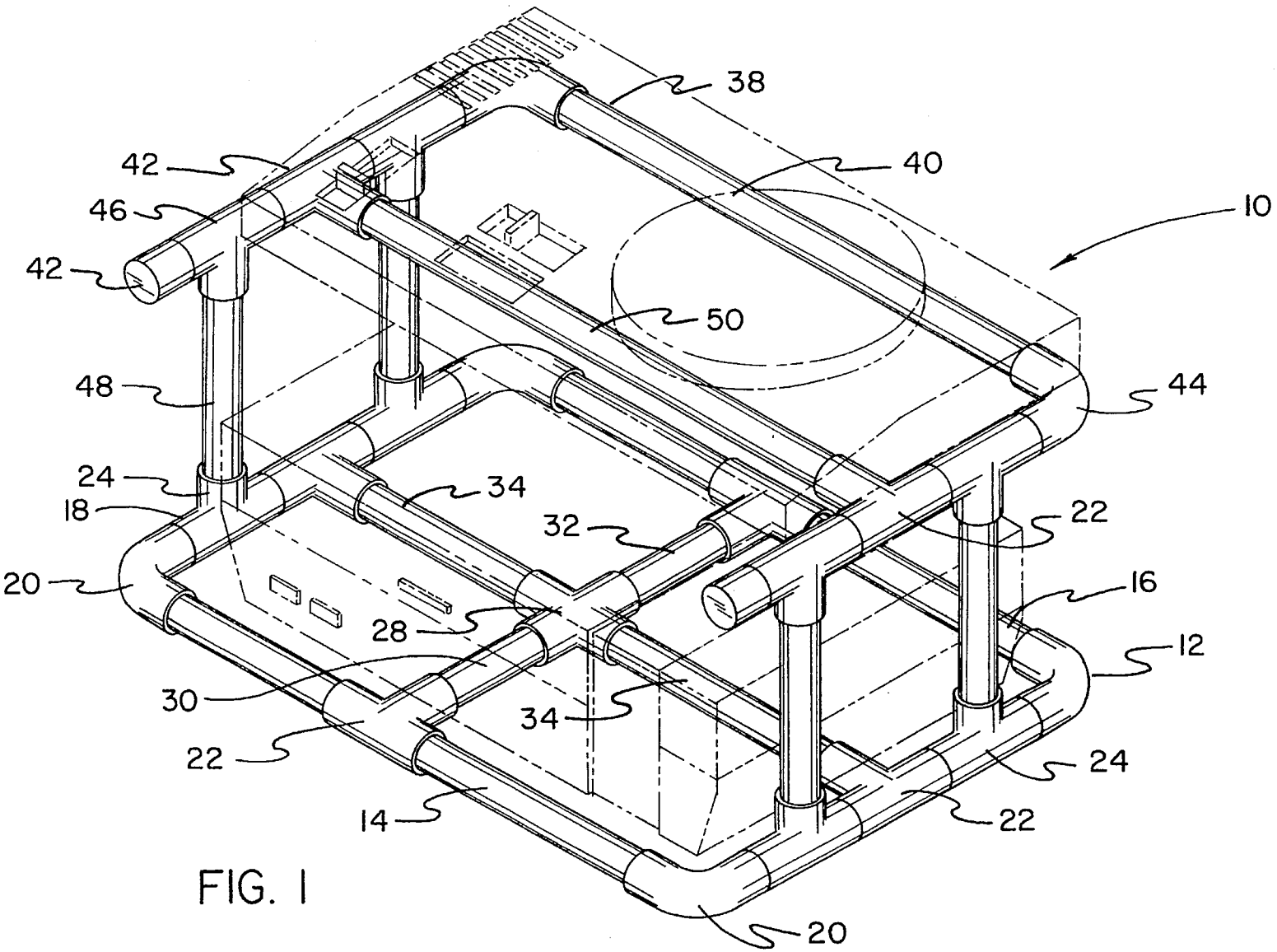
FIG. 1 is a perspective view of the preferred embodiment of the double video game rack and control deck constructed in accordance with the principles of the present invention.
Figure 2:
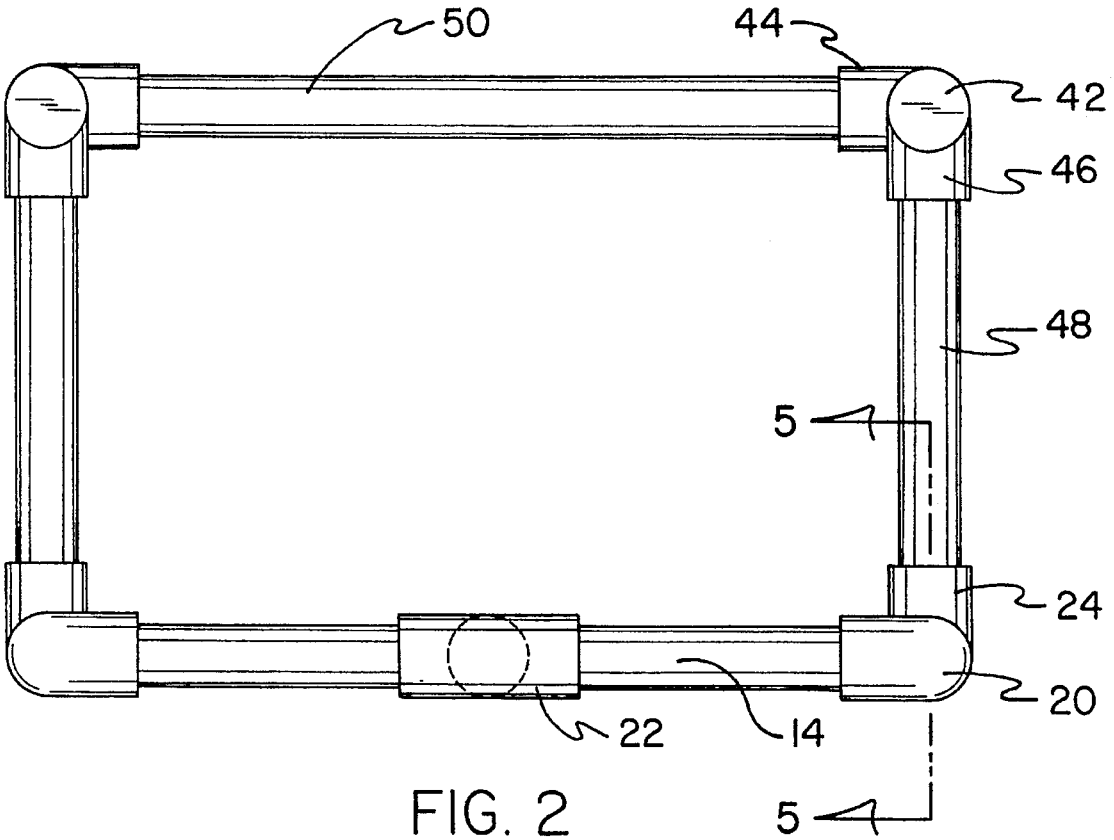
FIG. 2 is a front elevation view of the present invention.
Figure 3:
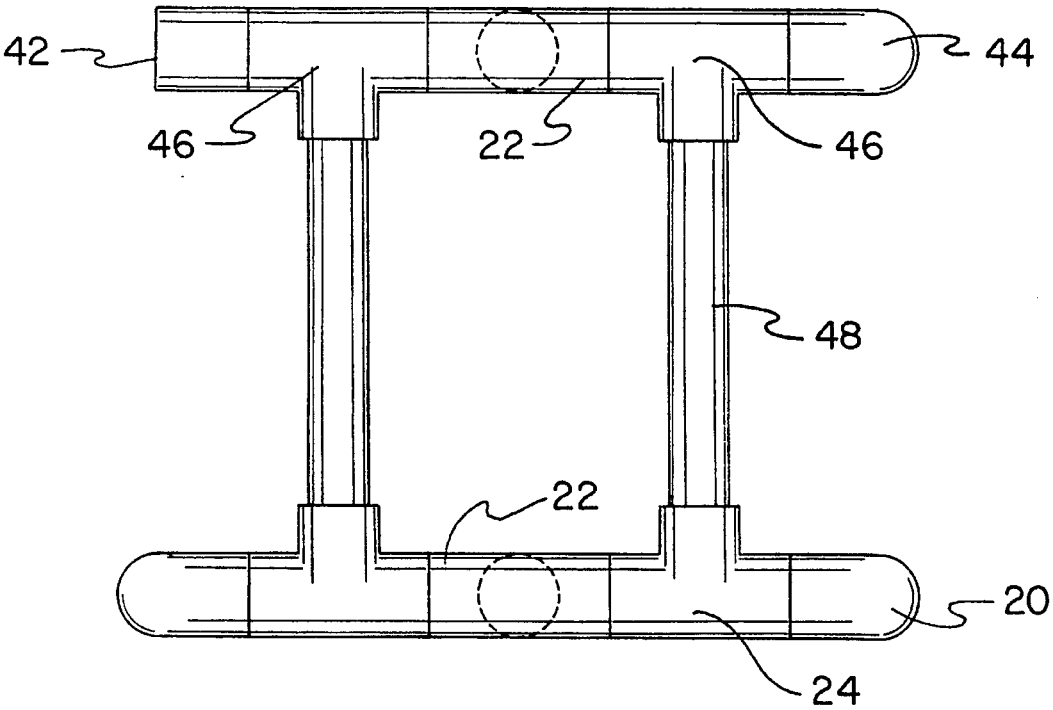
FIG. 3 is a side elevation view of the present invention.
Figure 4:
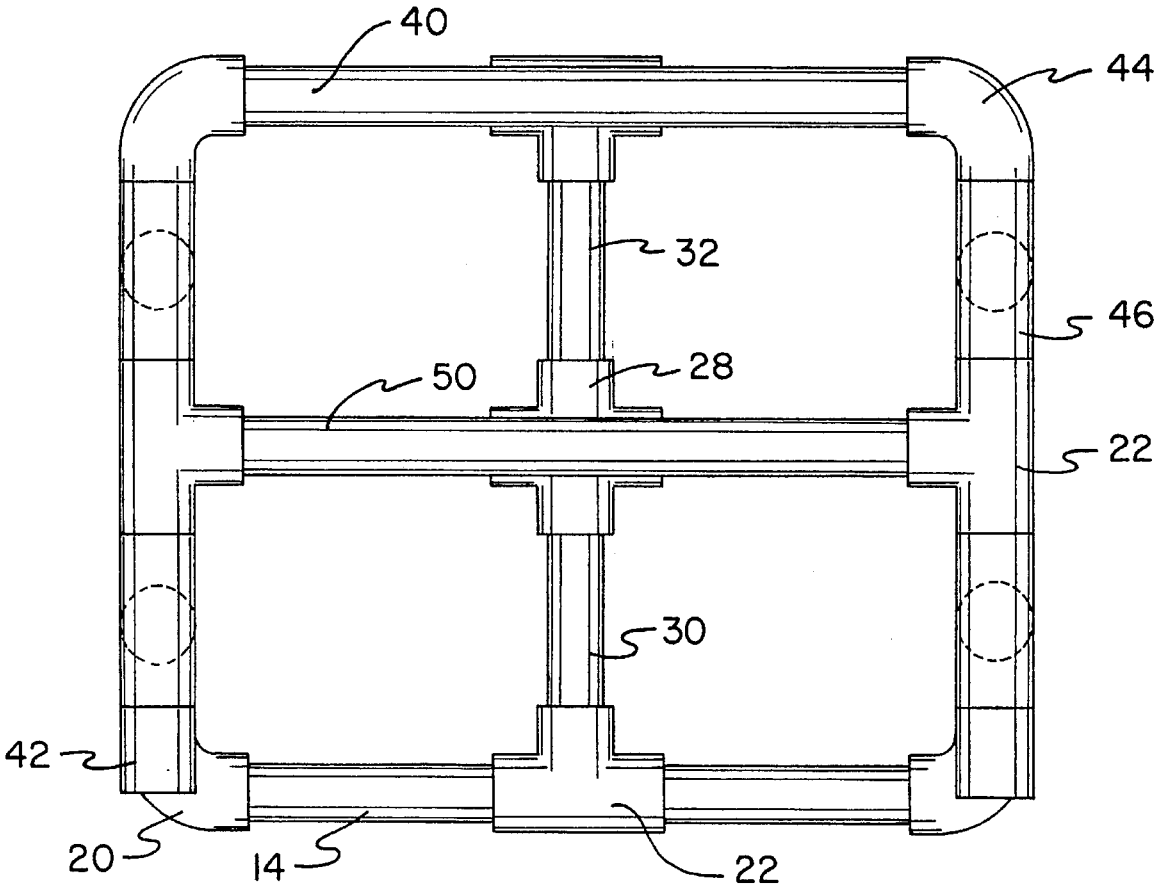
FIG. 4 is a bottom view of the preferred embodiment of the present invention.
Figure 5:
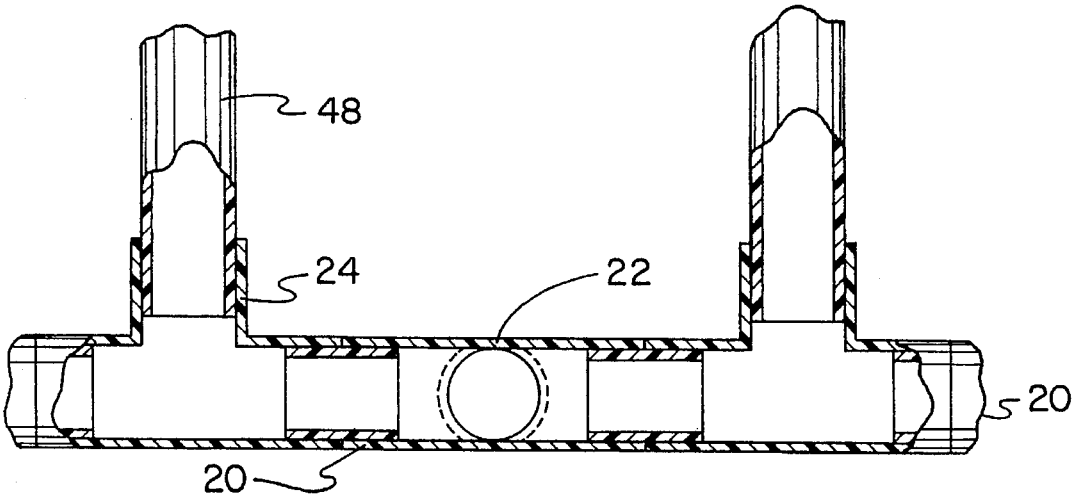
FIG. 5 is a cross-sectional view as taken along line 5—5 of FIG. 2.

With reference now to the drawings, and in particular, to FIG. 1 thereof, the preferred embodiment of the new and improved double video game rack and control deck embodying the principles and concepts of the present invention and generally designated by the reference number 10 will be described.

Specifically, it will be noted in the various Figures that the device relates to a new and improved double video game rack and control deck for holding two video games simultaneously making them more convenient to store and play. In its broadest context, the device consists of a hollow rectangular piece, a four way projecting piece, and a U-shaped upper shelf.

The device 10 contains a hollow rectangular base 12 having a front piece 14, a back piece 16, two side pieces 18, and an opening therebetween. The front piece 14 and the back piece 16 couple with the two side pieces 18 by elbow joints 20. The front piece 14 has an inwardly positioned projection 22 that is coupled with a middle portion thereof. The back piece 16 has an inwardly positioned projection 22 that is coupled with a middle portion thereof. Each of the two side pieces 18 has two upwardly extending projections 24 therefrom. Each of the two side pieces 18 has an inwardly positioned projection 22 disposed between the two upwardly extending projections 24 thereof. The coupling of all of the components of the hollow rectangular base 12 can be held together by a strong glue that will prevent the components from breaking apart.

The device 10 contains a four way projecting piece 28 that is positioned in the opening of the hollow rectangular base 12. The four way projecting piece 28 has a first extension 30 that couples with the inwardly positioned projection 22 of the front piece 14. A second extension 32 couples with the inwardly positioned projection 22 of the back piece 16. A third and fourth extension 34 couple with the inwardly positioned projection 22 of the two side pieces 18. The four way projecting piece 28 with the attached extensions serves to form a bottom shelf. The bottom shelf is designed to receive and support a video game system therein.

The device 10 contains a U-shaped upper shelf 38 having a back piece 40 and two side pieces 42. The back piece 40 couples with the two side pieces 42 by elbow joints 44. Each of the two side pieces 42 has two downwardly extending projections 46 therefrom. Each of the two downwardly extending projections 46 has a support bar 48 extending therefrom. Each support bar 48 couples with the upwardly extending projections 24 of the two side pieces 18 of the hollow rectangular base 12. Each of the two side pieces 42 has an inwardly extending projection 22 that is disposed between the two downwardly extending projections 46 thereof. An extension 50 having end portions is coupled with the inwardly extending projections 22 of the two side pieces 42 to form an upper shelf. The upper shelf is designed to receive and support a video game system therein.

Figure 6:
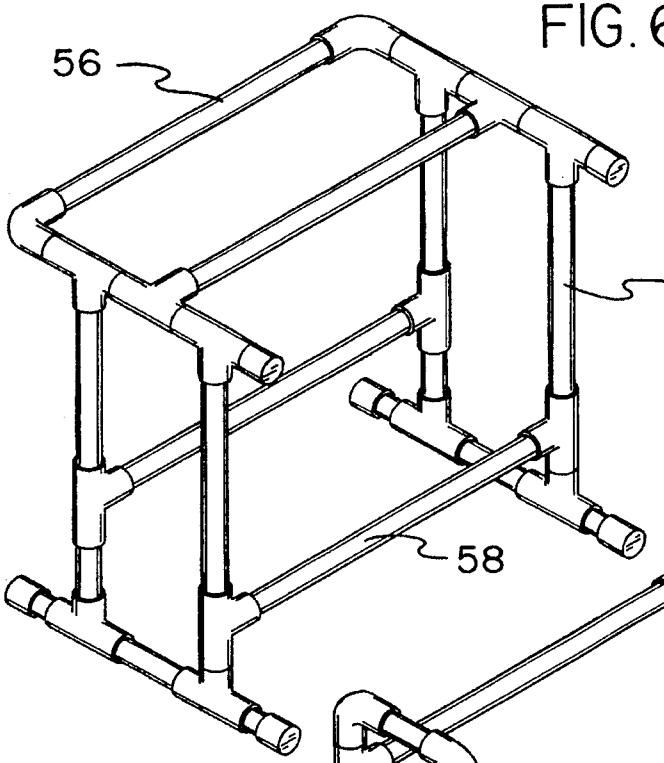
FIG. 6 is a perspective view of a second embodiment of the present invention.

A second embodiment 54 of the present invention is shown in FIG. 6 and includes an upper level 56 capable of holding a video game thereon and a lower level 58 capable of holding a plurality of video game cartridges in a semi-inverted position.

Figure 7:
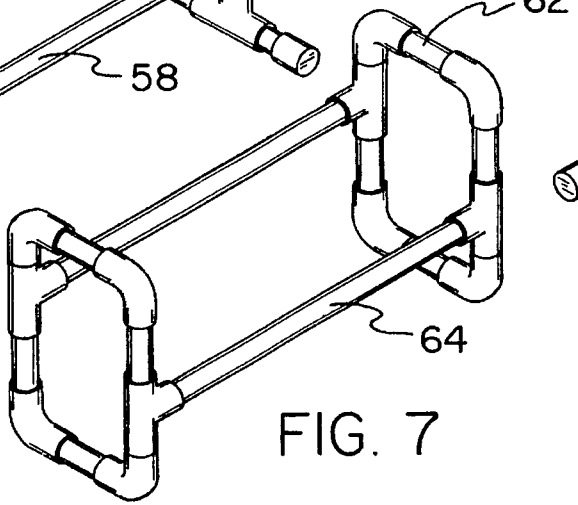
FIG. 7 is a perspective view of a third embodiment of the present invention.

A third embodiment 62 of the present invention is shown in FIG. 7 and includes a lower level 64 capable of holding a plurality of video game cartridges in a semi-inverted position.

Figure 8:
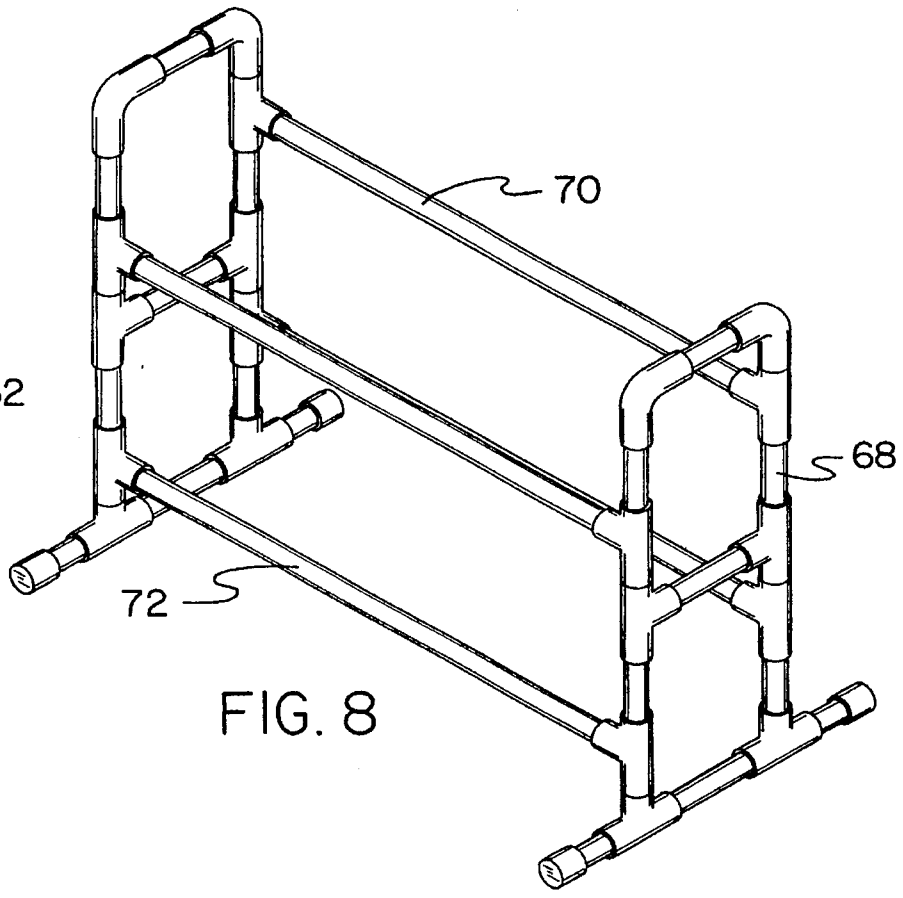
FIG. 8 is a perspective view of a fourth embodiment of the present invention.

A fourth embodiment 68 of the present invention is shown in FIG. 8 and includes an upper level 70 capable of holding a plurality of video game cartridges in a semi-inverted position and a lower level 72 capable of holding a plurality of video game cartridges in a semi-inverted position.

The present invention is a rack that is specially designed to hold two video games simultaneously which makes them more convenient to play and store.

This rack is made of durable lightweight PVC pipe and it has two levels. The bottom shelf is at floor level and is large enough to hold a regular Nintendo control deck. Approximately twelve inches above this is the second shelf which is completely open so that another control deck may be placed on it. The back of the rack is open to allow electrical cabling and cords to pass through it. An alternate model could have a storage shelf above the lower level, to hold up to fourteen video games. The rack is painted flat black, but could be manufactured in other colors.

The present invention is made so that both Nintendo and Super Nintendo can be kept together and off of the floor where they could be stepped on or broken. The rack can be placed on top of the TV or on the floor in front of the user if that is more comfortable. Both games are always right at hand, if the user desires to switch back and forth.

Families with multiple video games can have the convenience of storing both their favorites in one compact rack. It allows the user to position the control deck wherever it is most comfortable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved double video game rack and control deck for holding two video games simultaneously making them more convenient to store and play comprising, in combination:

a hollow-rectangular base having a front piece, a back piece, two side pieces, and an opening therebetween, the front piece and the back piece coupling with the two side pieces by elbow joints, the front piece having an inwardly positioned projection coupled with a middle portion thereof, the back piece having an inwardly positioned projection coupled with a middle portion thereof, each of the two side pieces having two upwardly extending projections therefrom, each of the two side pieces having an inwardly positioned projection disposed between the two upwardly extending projections thereof;

a four way projecting piece positioned in the opening of the hollow rectangular base, the four way projecting piece having a first extension coupling with the inwardly positioned projection of the front piece, a second extension coupling with the inwardly positioned projection of the back piece, a third and fourth extension coupling with the inwardly positioned projection of the two side pieces, the four way projecting piece with the extensions serving to form a bottom shelf;

a U-shaped upper shelf having a back piece and two side pieces, the back piece coupling with the two side pieces by elbow joints, each of the two side pieces of the upper shelf having two downwardly extending projections therefrom, each of the two downwardly extending projections having a support bar extending therefrom, each support bar coupling with the upwardly extending projections of the two side pieces of the hollow rectangular base, each of the two side pieces of the hollow rectangular base having an inwardly extending projections disposed between the two downwardly extending projections thereof, an extension having end portions coupling with the inwardly extending projections of the two side pieces of the hollow rectangular base to form an upper shelf.

* * * * *